United States Patent [19]

Arato et al.

[11] 4,260,039

[45] Apr. 7, 1981

[54] FOLDING, COLLAPSIBLE LADDER ASSEMBLY

[76] Inventors: Paul T. Arato, 86 Rusty Crestway, Willowdale, Ontario, Canada, M2J 2Y4; Oscar T. Arato, 25 Kensington Ave., Willowdale, Ontario, Canada, by Patricia A. Arato, legal representative

[21] Appl. No.: 19,678

[22] Filed: Mar. 12, 1979

[30] Foreign Application Priority Data

Mar. 10, 1978 [CA] Canada ..... 298716

[51] Int. Cl.[3] ..... E06C 1/52

[52] U.S. Cl. ..... 182/164; 182/198

[58] Field of Search ..... 182/164, 163, 156, 196, 182/197, 198

[56] References Cited

U.S. PATENT DOCUMENTS 905,529 12/1908 Hengstler ..... 182/197

*Primary Examiner*—Reinaldo P. Machado

*Attorney, Agent, or Firm*—Hirons, Rogers & Scott

[57] ABSTRACT

A collapsible, foldable ladder of use as an emergency escape means such as a fire escape ladder, has a plurality of channel section rungs extending from side to side across the width of the ladder, and side support means extending between adjacent rungs at ends thereof. The side support means each comprise two pivotally connected, rigid sections, pivotally connected to the ends of upper and lower rungs. The ladder can be collapsed, whereupon the side support members fold inwardly and fit within the channel sections of the rungs, so that the rungs rest upon top of one another, and extended e.g. under its own weight when suspended by one end, whereupon the side support members are extended perpendicularly to the transverse extent of the rungs.

4 Claims, 3 Drawing Figures

FOLDING, COLLAPSIBLE LADDER ASSEMBLY

FIELD OF THE INVENTION

This invention relates to ladders, and more especially to ladders of the type which are collapsible for storage purposes, and extendable for use as an emergency escape means, e.g. in case of fire.

BACKGROUND OF THE INVENTION AND PRIOR ART

Traditional folding ladders have rope side members and rigid, wooden or the like rungs extending between the ropes. Whilst these can be stored in confined spaces, and will extend into their useful position immediately on suspension by one end from a fixed structure, they nevertheless have certain disadvantages. Due to their overall flexible nature, they present storage problems and are liable to become entangled when folded or coiled for storage. Their flexible nature in operation tends to discourage their use by people unfamiliar with them.

It is an object of the present invention to provide a novel form of collapsible ladder which overcomes or at least reduces at least one of the aforementioned disadvantages.

SUMMARY OF THE INVENTION

According to the present invention, there is provided a collapsible ladder assembly comprising: a plurality of rungs extending from side to side across said assembly, in mutually parallel relationship; side support members extending between adjacent rungs, each of said side support members being pivotally secured at one end to individual ones of a pair of adjacent rungs, and comprising at least two generally rigid sections pivotally connected, intermediate the length of said side support members, about a pivot axis extending outwardly substantially perpendicularly to the direction of length of the ladder and substantially perpendicularly to the direction of length of the rungs, to permit movement of the side support members inwardly in a direction towards one another between an extended, rung separated position and a collapsed, rung closed position.

Such a ladder offers the convenience of being collapsible to occupy a very small storage space, without leaving exposed flexible ropes, lines or the like which are liable to entanglement and damage.

BRIEF REFERENCE TO THE DRAWINGS

DESCRIPTION OF THE PREFERRED EMBODIMENTS

Figure 1:
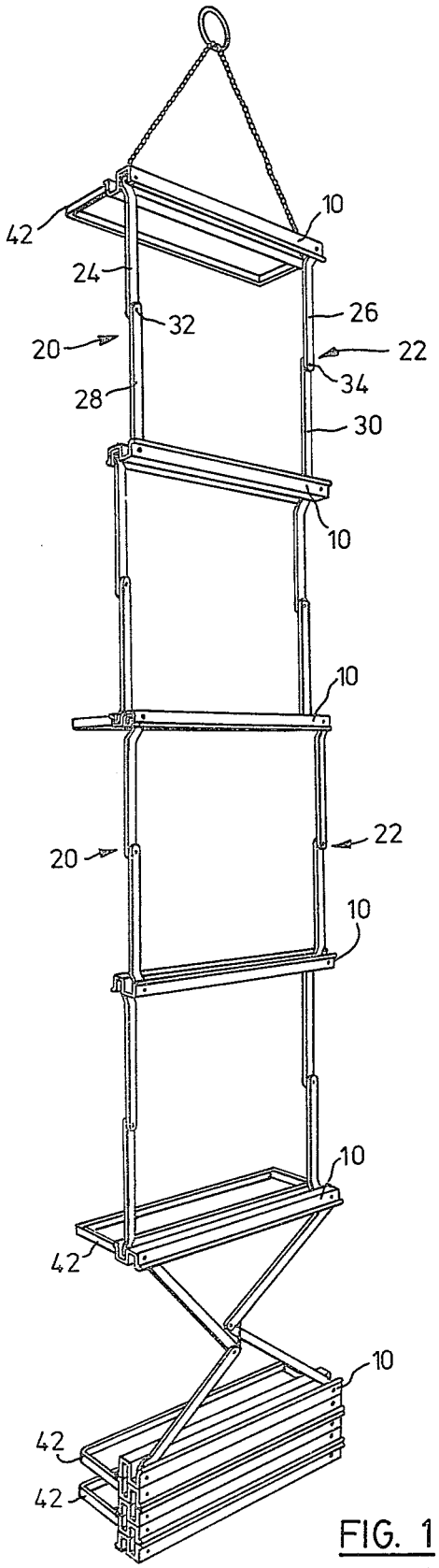
FIG. 1 is a perspective, front view of a ladder according to the present invention, in a partially extended position.

The ladder can be suitably suspended by one end, e.g. by hook formations, rope handle attachments or other suitable suspended means provided at one end thereof, and will open to its extended, rung separated position under its own weight upon such suspension, to provide a substantially rigid ladder structure which is readily mounted or dismounted by any persons other than the most infirm.

In an alternative arrangement, the upper end of the ladder is provided with one or more hook arrangements so that it can be hooked over a window sill for support. The hook arrangements can be disposed to protrude outwardly from the sill over the ladder extending therebelow, to provide hand holds for the user. A transverse bar may also be provided at the top of the ladder, to extend across the inside of the window opening, of length, optionally adjustable to permit it to engage structure at the sides of the window opening to support the ladder therein.

Preferably, the side members in their collapsed position are disposed inwardly of the ends of the rungs, and extend in a direction towards each other, to be in the same plane as the rungs. This minimizes the storage space required for the ladder in the collapsed position, by preventing lateral protrusion of collapsed side members therefrom. Most preferably, the rungs of the ladder are of channel section, with upwardly and/or downwardly presented channels extending substantially the full length of the rung, and adapted to receive therein the collapsed side members in neat, storage arrangement.

DETAILED DESCRIPTION OF THE SPECIFIC PREFERRED EMBODIMENT

Referring now to the drawings, in which like reference numerals indicate like parts, the ladder according to the present invention has a plurality of rungs 10 extending transversely across the width of the ladder and in mutually parallel relationship to one another. The rungs 10 are all disposed substantially in a single vertical plane, as seen in FIG. 2.

In cross section, the rungs 10 are each of the form of a double channel, having a first, upwardly presented channel 12 and a second, downwardly presented channel 14, arranged in side by side relationship and extending along substantially the full length of the rung 10. This configuration is best seen in FIG. 2. The rungs 10 can thus be a single piece extrusion of rigid material such as aluminum. The rungs 10 are disposed vertically with respect with one another in the ladder assembly so that, in the collapsed position as shown at the lower part of FIG. 2, adjacent rungs stack on top of one another, with upwardly presented channels 12 meeting downwardly presented channels 14 to define between them a space comprised of the volume of both channels. The base wall formations 16, 18 of respective upwardly presented channels 12 and downwardly presented channels 14 stack on one another in the collapsed position for neat, compact storage.

At the ends of a rung 10 there are pivotally secured opposed side support members 20, 22, one at each transverse end thereof, and extending upwardly and downwardly to the next adjacent rung 10. The side support members 20, 22 comprise an upper section 24, 26 respectively, a lower section 28, 30, respectively, and an intermediate pivot pin 32, 34 respectively, by means of which respective upper and lower sections are pivotally secured together. The upper section 24 has a downwardly presented hooked formation 36 at its upper extremity, the width of the hooked formation 36 being such as to permit reception thereof within the width of downwardly presented channel 14 of rung 10 and with sufficient tolerance to permit pivotting therein. The lower section 28 similarly has an upwardly presented hooked formation 38 at its lower extremity, pivotally received in aligned, upwardly presented channel 12 of the next lower rung 10. All of the side support members 20, 22 etc. are of substantially the same construction. Each rung 10 is provided at each end with a circular section rivet 40 extending horizontally through the side walls of both channels 12, 14 and through the side walls of hooked formation 36 of the upper extremity of upper section 24 of a side support member extending downwardly to the next downwardly adjacent rung 10, and through the side walls of hooked formation 38 at the lower extremity of a lower section 28 of a side support member extending upwardly to the next upwardly adjacent rung 10. The rivets 40 pivotally secure the side support members 20, 22 etc. to the ends of the rungs 10.

Figure 2:
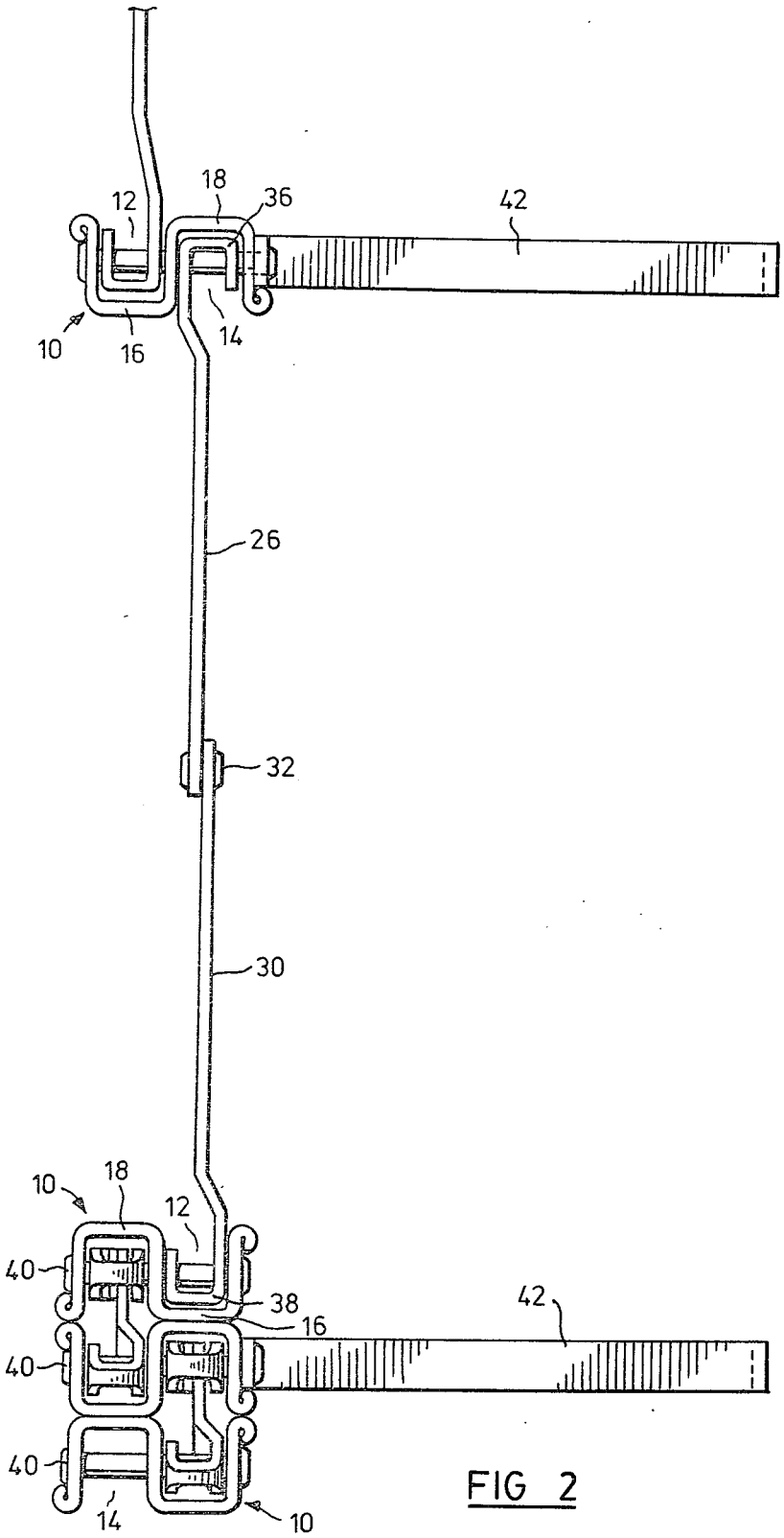
FIG. 2 is an end view of one side of the ladder of FIG. 1.
Figure 3:
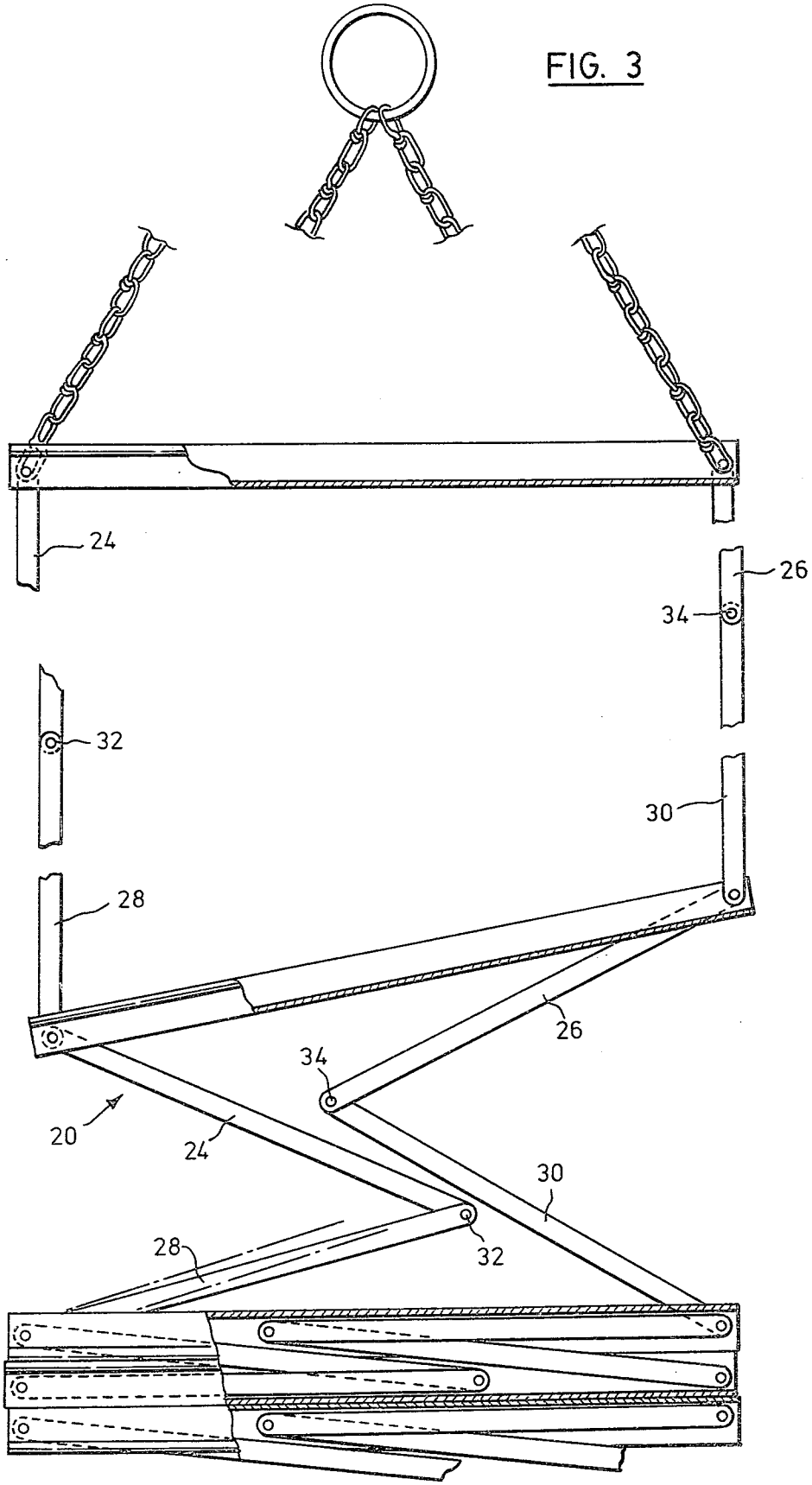
FIG. 3 is a detailed front view, partly in section, of parts of the ladder of FIGS. 1 and 2.

When the ladder assembly is in extended, rung separated position as shown at the upper part of FIGS. 1, 2 and 3, the upper and lower sections 24, 28 and 26, 30 of respective opposed side support members 20, 22 are in vertical alignment with one another, and disposed at opposite sides of the rungs 10, so that the space between adjacent rungs 10 is unobstructed and the user has plenty of room for the placement of a foot on a rung 10. When the ladder assembly is moved towards its collapsed position, upper and lower sections pivot about intermediate pivot pins 32, 34 and end pivoting rivets 40 to "break" inwardly, so that the side support members 20, 22 extend towards each other in the vertical plane of the rungs 10. As the ladder assembly is brought to its fully collapsed position, shown at the bottom of FIGS. 1, 2 and 3, the upper and lower sections 24, 28 of side support member 20 fold about pin 32 to be received within the confines of upwardly presented channel 12 and downwardly presented channel 14 of two adjacent rungs 10. Similarly the upper and lower sections 26, 30 of opposed side support members 20 fold about pin 34. Lower section 28 of side support member 20 folds to lie along the bottom 16 of upwardly presented channel 12, extending more than half way along the rung, as shown in FIG. 3. Upper section 24 of side support member 20 folds to extend from pivot pin 32 at the end of lower section 28 at a slight upward inclination within the space defined between abutting channels 12, 14 to rivet 40 at the end of the upper channel section. At the other side of rung 10, lower section 30 of side support member 22 folds inwardly to the same slight upward inclination as section 24. At the central region of the rung 10, the side support members overlap in the collapsed position, as shown in FIG. 3. The section of side support member 22 lie on top of those from support member 20, with the upper section 26 lying horizontal along the upper wall 18 of upper channel 14. The width of the channel 12, 14 is sufficient to accommodate this side by side disposition of sections, and of sufficient height to accommodate their vertical stacking as illustrated. By provision of accommodation for overlapping lengths of collapsed side support members, greater freedom of design of the dimensions of the ladder is obtained. Thus, the separation of the adjacent rungs 10 of the ladder in its extended, in-use position does not have to be related to the lateral separation of the side support members, and hence the width of the rungs 10, to accommodate inward folding of the side support members on collapse of the ladder. With the provision of overlap between the folded side support members as shown, any convenient relationship of rung length to rung separation can be accomplished.

It will thus be appreciated that, in its collapsed position, the ladder enfolds within its rung structures the side support members, and substantially totally enclose them. Thus, lubrication applied to the respective pins will be maintained in good operative condition for extended periods of time, since the lubricated pivot pins are substantially protected from atmospheric conditions. Also, convenient, neat, compact storage of the ladder is obtained, since none of the side support members protrude laterally from it, in its collapsed position.

As indicated in FIG. 2, some of the rungs 10 are provided with projecting stand-off formations 42, suitably attached to an outer side wall of the rung 10, and protruding in a direction generally perpendicular to the vertical extent of the ladder and to the transverse extent of the rung 10. Such stand-off formations 42 are provided in pairs, one at each end of a selected rung, and abut against a wall surface alongside which the ladder may be hung, to provide suitable foot etc. clearance between the ladder and the wall in use.

The ladder assembly according to the invention may include suitable upper attachment formations of conventional form, at its upper end, by which it may be suspended from a fixed structure in use. Such formations may be hooks, loops, clamps, rope attachments etc. When thus suspended, the ladder should fall open, to its extended position, under its own weight, rapidly and easily for best use under emergency conditions. Refolding of the ladder to its collapsed position does not need to be accomplished so rapidly, since it will not normally need to be done in emergencies. In the illustrated arrangement, collapse of side support members 20 should be commenced marginally ahead of collapse of side support members 22, as indicated in FIG. 3, since members 20 are to lie below members 22 in the collapsed position. If desired, means can be included on the sections of the side support members 20, 22 to prevent their assuming an exactly vertically aligned disposition when the ladder is extended, such as engaging stop formations adjacent the pivot pins 32, 34. Then the ladder assembly can be moved to its collapsed position just by urging its two ends towards each other. Such an arrangement is not however necessary, in the simplest and most economical useful embodiment of the invention.

It will of course be appreciated that other variations and modifications, within the general scope and spirit of the invention can be made, the above description being given for illustrative and not limitative purposes. The scope of the invention is limited only by the appended claims.

We claim:

1. A collapsible ladder assembly comprising:

a plurality of rungs extending from side to side across said assembly in mutually parallel relationship, each said rung being a channel section with an upwardly presented channel and a downwardly presented channel in side by side relationship extending across substantially the full length of the rung;

side support members extending between adjacent rungs, each of said side support members being pivotally secured at its ends to the ends of individual ones of a pair of adjacent rungs, and comprising at least two generally rigid sections pivotally connected together, intermediate the length of said side support member, about a pivot axis extending outwardly substantially perpendicularly to the direction of length of the ladder and substantially perpendicularly to the direction of length of the rungs, to permit movement of the side support members inwardly in a direction towards one another between an extended, rung separated position and a collapsed, rung closed position;

both of said channels of each rung being wide enough to accommodate two sections of a side support member in side by side relationship, each rung being adapted to abut against the next adjacent rung in alignment therewith in the collapsed position of the ladder, with the downwardly presented channel of one rung meeting the upwardly presented channel of the other rung, to define therebetween a space having the vertical height of the combined depth of both channels, to accommodate therein two collapsed side support members in lengthwise-overlapping, vertically stacked relationship.

2. The ladder assembly of claim 1 wherein said side support members are movable from their collapsed position to their extended positions under weight of the ladder upon vertical suspension of the ladder from an upper end thereof.

3. The ladder assembly of claim 1 wherein each rung is a single extruded metal profile.

4. The ladder assembly of claim 1 including at least a pair of protruding stand-off bars protruding laterally outwardly from a rung of the ladder assembly, at opposed ends thereof.

* * * * *